United States Patent [19]

Wolf

[11] 4,212,255

[45] Jul. 15, 1980

[54] SEWING MACHINE TREADLE WITH A VARIABLE LENGTH CONTROL LINKAGE

[75] Inventor: Paulus W. Wolf, Karlsruhe, Fed. Rep. of Germany

[73] Assignee: The Singer Company, Stamford, Conn.

[21] Appl. No.: 32,806

[22] Filed: Apr. 24, 1979

[51] Int. Cl.[2] ..... D05B 75/06

[52] U.S. Cl. ..... 112/217.1

[58] Field of Search ..... 112/260, 217.1, 258, 112/217.4, 217.3, 217.2; 74/527; 403/33, 388, 389; 108/145, 146; 292/305, 306, 125

[56] References Cited

U.S. PATENT DOCUMENTS

| | | | |
|---|---|---|---|
| 595,352 | 12/1897 | Snell, Jr. | 108/146 X |
| 2,348,043 | 5/1944 | Webb et al. | 112/217.1 |
| 2,469,968 | 5/1949 | Kessler | 112/258 X |
| 2,875,006 | 2/1959 | Hale | 112/217.1 |
| 2,899,249 | 8/1959 | Kishibay | 112/217.1 |
| 3,915,102 | 10/1975 | Barron | 108/146 X |

*Primary Examiner*—Werner H. Schroeder
*Assistant Examiner*—Andrew M. Falik
*Attorney, Agent, or Firm*—Elliot A. Lackenbach; Robert E. Smith; Edward L. Bell

[57] ABSTRACT

Sewing machine stand having an adjustable height telescoping pedestal and adjustable link rods connecting a treadle with the sewing machine wherein the link rods are provided with remotely operable locking means which can be operated simultaneously with the pedestal height locking means.

5 Claims, 3 Drawing Figures

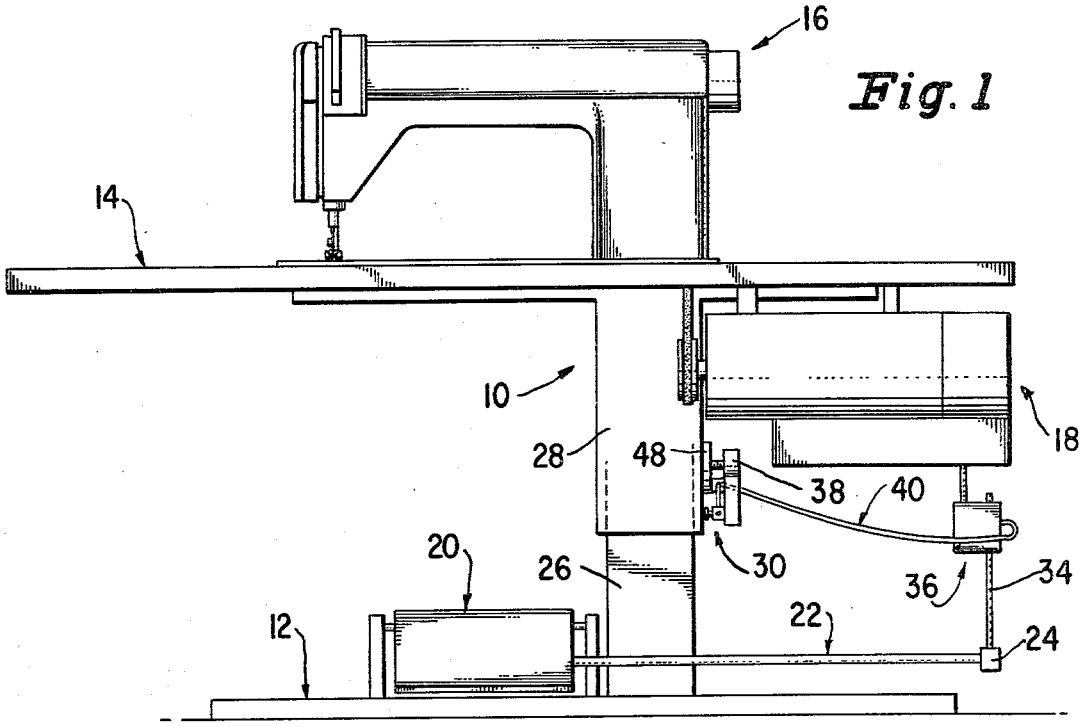
Fig. 1
Fig. 2
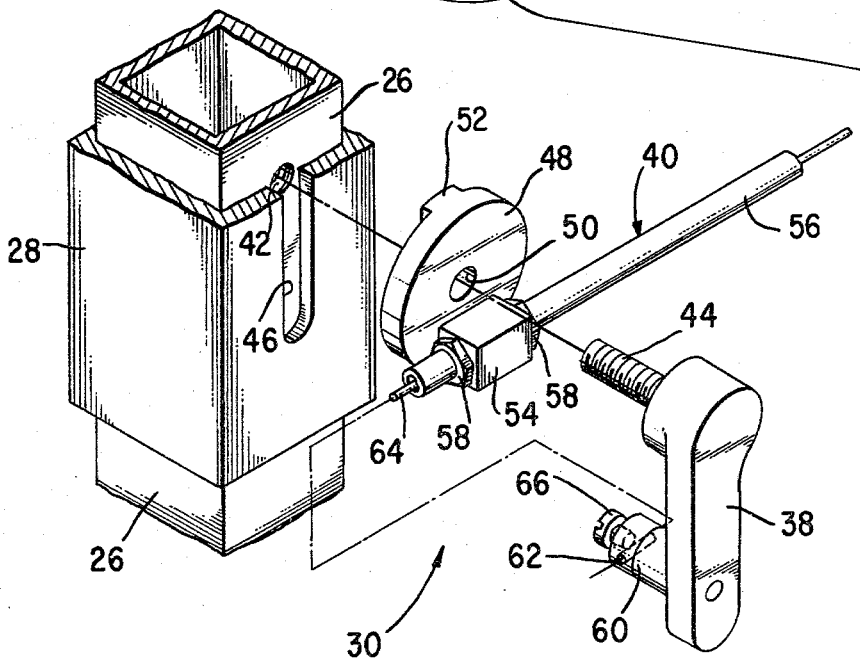

SEWING MACHINE TREADLE WITH A VARIABLE LENGTH CONTROL LINKAGE

This invention relates to adjustable stands for sewing machines.

Commercial or industrial sewing machines are generally mounted on stands to position the sewing head at a convenient height for the operator with the stand often being provided with one or more treadles to be moved by the operator's foot or feet for controlling the sewing machine. It is often desirable to make the stand adjustable so that the height of the sewing machine can be varied and to provide an adjustable linkage between the treadle and the machine. Heretofore, when the height of a sewing machine stand was adjusted, a separate adjustment operation or setting was required of the treadle linkage, requiring extra time and effort.

Bearing in mind the foregoing, it is among the objects of the present invention to provide novel and improved stands for sewing machines which are adjustable in height, which are provided with one or more treadles or operating instrumentalities having adjustable control linkages. The adjustable control linkages are synchronized with or automatically accomplished in response to stand height adjustment as by a single operating handle therefor. The stand comprises a telescoping support post provided with means for locking the telescoping members selectively together connected with locking means for the treadle control linkages so that locking or unlocking of the pedestal locking means will automatically lock or unlock, respectively, the control linkages, and wherein this is achieved safely, economically and efficiently.

The invention will be better understood and other objects, characteristics, features, and advantages thereof will appear as the following description proceeds, with reference to the appended drawing given solely by way of example illustrating an embodiment or modification of the present invention and wherein:

FIG. 1 is an elevational view of an adjustable stand and a sewing machine including the present invention;

FIG. 2 is an enlarged exploded perspective view of the height adjusting means for the stand of FIG. 1.

Figure 3:
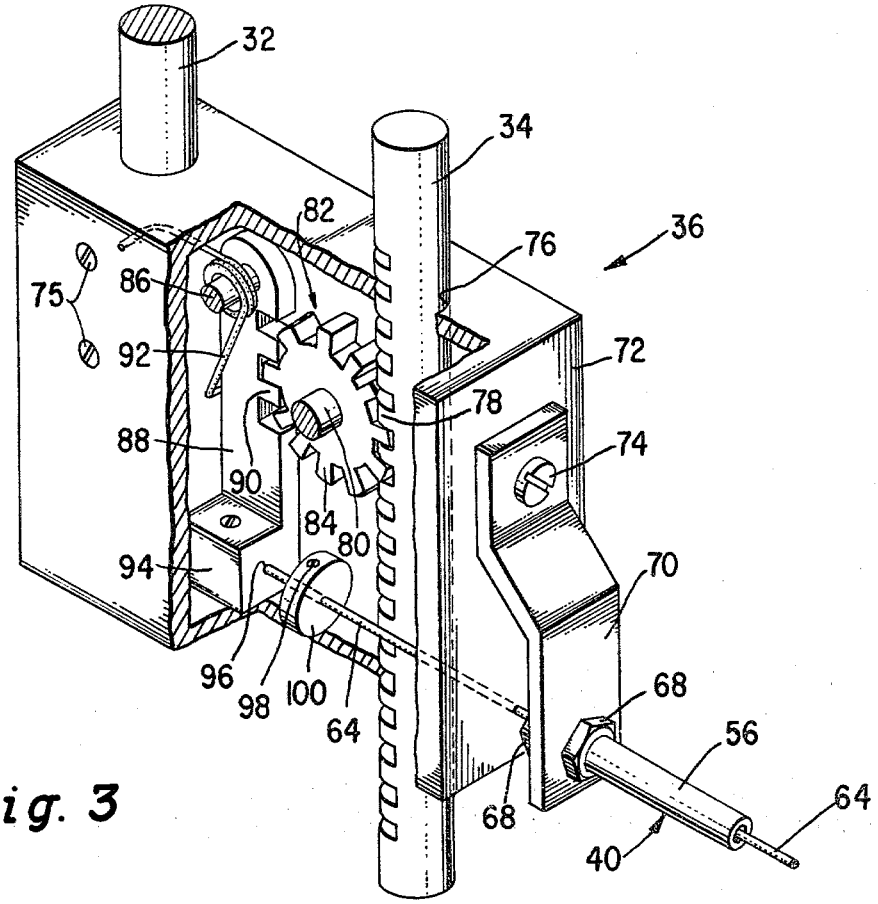
FIG. 3 is an enlarged isometric illustration, partially broken away, of the control linkage adjusting means of the stand of FIG. 1.

With reference now to the drawing, the adjustable stand comprises telescoping column post or pedestal means 10, base means 12 and machine supporting means 14 having sewing machine head 16 and motor or transmitter 18 mounted on supporting means 14. The stand is also provided with treadle means 20 operably connected by linkage means 22 including an operating arm 24 adopted to be rotated in a vertical plane in response to movement of treadle means 20 by an operator. Pedestal means 10 is of an adjustable height comprising, for example, inner and outer telescoping square tubular members 26 and 28, respectively, and provided with pedestal locking means 30 for selectively locking the supporting means 14 at a desired height and unlocking pedestal 10 for height adjustment. Arm 24 is connected with transmitter 18 by variable length control or connecting linkage means comprising upper and lower connecting link rods 32 and 34, respectively, selectively locked relative one another for simultaneous movement to operate transmitter 18 in response to movement of treadle 20 and unlocked for relative movement therebetween to enable length adjustment to correspond to height adjustment of pedestal 10, as by means of remotely actuable link rod locking means 36. Pedestal locking means 30 and link rod lock means 36 are connected together for simultaneous operation, as by turning movement of an operating handle lever 38 provided in the pedestal locking means 30, by bowden cable means 40 providing remote actuation of link rod locking means 36.

Referring more particularly to FIG. 2 inner tubular member 26 is provided with a threaded hole 42 and handle 38 is provided with a threaded stud 44 for engaging threaded hole 42. Outer member 28 is provided with a generally vertically extending elongated slot 46 providing clearance for stud 44. A washer or tension disc 48, provided with a clearance aperture 50 surrounds threaded stud 44 and has a lug 52 for sliding engagement within slot 46. Clockwise rotation of handle lever 38 clamps telescoping pedestal means 10 at a desired height. Counter clockwise rotation releases the clamping pressure and enables height adjustment.

Disc 48 has lug 54 attached with the outer sleeve 56 of cable 40, as by nuts 58. Handle lever 38 carries a stud 60 having a radial aperture 62. The inner wire 64 of cable 40 is clamped by a clamp screw 66. Clockwise movement of the handle lever 38 to clamp or lock pedestal 10 pulls inner wire 64 of the cable 40.

Referring now to FIG. 3, the link rod end portion of cable 40 is attached with the link rod lock means 36 by nuts 68 engaging a mounting strap 70 mounted with a housing or case 72 by a screw 74. Case 72 is fixedly mounted with the lower end portion of the upper link rod 32, as by set screws 75. The upper end portion of lower link rod 34 passes through a pair of aligned apertures 76 in case 72 and is provided with a rack means having teeth 78. Journalled to case 72 by a stud shaft 80 is a pinion gear 82 having its teeth 84 engaging rack teeth 78 so link 34 can only slidably move relative case 72 during rotation of gear 82. Pivotally mounted with case 72, as by means of a stud shaft 86 is a swingable toothed pawl member 88 having teeth 90 selectively engagable with gear 82 to prevent rotation thereof to lock link rods 32 and 34 together. A spring 92 biases the pawl member 88 into locking engagement with gear 82. Pawl member 88 has a lug 94 with an aperture 96 through which inner wire 64 of cable 40 is passed. Clamped to wire 64 by a set screw 98 is an actuating collar 100 generally adjacent to the lug 94. Hence, outward movement of wire 64 from cable 40, corresponding to inward movement of the other end portion thereof by counter clockwise or unlocking movement of handle lever 38, is effective to push collar 100 against the lug 94, swinging pawl member 88 against the biasing of spring 92 and releasing gear 82 for rotation, thereby unlocking link rods 32 and 34 from one another so that upon height adjustment of pedestal 10, link rods 32 and 34 will be automatically adjusted in their combined length. Upon re-tightening of the pedestal locking means 30, wire 64 will pull collar 100 away from lug 94, enabling spring 92 to again bias pawl member 88 towards engagement with gear 82. If the teeth do not exactly line up, the first operation of treadle 20 will provide sufficient small movement between the link rods 32 and 34 to quickly lock them together. A clearance, as shown, between collar 100 and lug 94 when in the locked position assures that the link rod locking means 36 can never reflect pressure back against handle lever 38 so that handle lever 38 can always be tightened as tightly as necessary to prevent inadvertent movement or collapse of the stand.

While the invention has been described and illustrated in terms of a preferred embodiment of modification, such technical equivalence to the means described as well as their combination, and other embodiments or modifications as may be suggested to those having the benefit of the teachings herein are intended to be reserved should they be carried out according to the spirit of the invention.

I claim:

1. An adjustable height sewing machine stand comprising base means, telescoping column pedestal means extending upwardly of said base means for supporting a sewing machine at an adjustable height above said base means, column pedestal locking means for selectively locking said pedestal means to support such machine at a desired height above said base means and unlocking said pedestal means for raising and lowering such machine, treadle means associated with said base means for movement in response to foot pressure by a machine operator, variable length control linkage means connected with said treadle means and connectable with such machine to enable operator foot control thereof, said linkage means including a pair of generally parallel link rods, link rod locking means for selectively locking said link rods together to enable movement of said treadle means to be transmitted through the locked said link rods and unlocking said link rods to enable adjustment of the combined length thereof, and remote actuating means for said link rod locking means enabling adjustment thereof into a locking or unlocking mode during adjustment of said pedestal means.

2. Sewing machine stand defined in claim 1 wherein said remotely operable actuating means is structurally and operatively associated with said pedestal locking means for operation therewith so that said link rods may be locked and unlocked substantially simultaneously therewith.

3. Sewing machine stand defined in claim 2 wherein said pedestal locking means comprises a handle lever and said remote actuating means comprises a bowden cable connected for operation with said lever.

4. Sewing machine stand defined in claim 3 wherein said pedestal means comprises telescoping inner and outer tubular members, said outer member being provided with a generally longitudinally extending slot, said inner member being provided with a threaded hole aligned with said slot and said locking means comprises a threaded stud connected with said handle lever for rotation thereby extending through said slot and threadedly engaged with said threaded hole for selectively clamping said inner and outer members together.

5. Sewing machine stand defined in any of claims 1 through 4 wherein said link rod locking means comprises case means fixedly mounted with one of said link rods and slidably engaging the other of said link rods, said other of said link rods being provided with rack means extending within said case, pinion gear means rotatably carried within said case engaged with said rack means, a toothed swivelable pawl member pivotably mounted with said case for selective engagement with said pinion gear means to prevent rotation thereof relative said case and disengaged therefrom enabling rotation thereof in response to movement of said other of said link rods, said remotely actuable actuating means being operatively and structurally connected with said swingable member for moving it selectively between said engaged and disengaged positions thereof.

* * * * *